US006136111A

United States Patent [19]

Lemons et al.

[11] Patent Number: 6,136,111

[45] Date of Patent: Oct. 24, 2000

[54] COMBUSTIBLE COMPOSITION FOR USE IN VEHICLE SAFETY SYSTEMS

[75] Inventors: Kelly W. Lemons, Hollister; Albert J. Baggett, Jr., San Carlos; William D. Fahey, Cupertino, all of Calif.; Lawrence Weinman, Huntsville, Ala.

[73] Assignee: Quantic Industries, Inc., San Carlos, Calif.

[21] Appl. No.: 09/421,300

[22] Filed: Oct. 20, 1999

Related U.S. Application Data

[63] Continuation of application No. 08/858,183, May 28, 1997, abandoned.

[60] Provisional application No. 60/018,692, May 30, 1996.

[51] Int. Cl.[7] ..... C06B 45/10

[52] U.S. Cl. ..... 149/19.3

[58] Field of Search ..... 149/19.3

[56] References Cited

U.S. PATENT DOCUMENTS

| | | | |
|---|---|---|---|
| 3,109,761 | 11/1963 | Cobb et al. | 149/19.3 |
| 3,291,665 | 12/1966 | Jackson et al. . | |
| 3,642,705 | 2/1972 | Zollinger et al. | 149/19.3 |
| 3,647,891 | 3/1972 | Loudas et al. | 149/19.3 |
| 3,652,350 | 3/1972 | Timmermans . | |
| 3,653,994 | 4/1972 | Batchelder et al. | 149/19.3 |
| 3,657,336 | 4/1972 | Mayes et al. | 149/19.3 |
| 3,690,972 | 9/1972 | Kaye et al. . | |
| 3,725,516 | 4/1973 | Kaufman . | |
| 3,734,788 | 5/1973 | Kaufman . | |
| 3,876,477 | 4/1975 | Eldridge et al. | 149/19.3 |
| 4,038,115 | 7/1977 | Dehm et al. | 149/19.8 |
| 4,042,430 | 8/1977 | Falterman et al. . | |
| 4,131,499 | 12/1978 | Flanagan et al. | 149/19.3 |
| 4,445,947 | 5/1984 | Shaw et al. | 149/19.3 |
| 5,472,536 | 12/1995 | Doris et al. | 149/41 |

*Primary Examiner*—Edward A. Miller

*Attorney, Agent, or Firm*—@Patent Planet; Robert Moll; Chuck Holland

[57] ABSTRACT

Disclosed are compositions that are useful as microgas-generators, which can be used as propellants in airbags or seatbelt pretensioners. The compositions use a fuel which comprises an organic compound having a high ratio of the number of reactive carbon-oxygen groups to the total number of carbon atoms. The compositions also optionally use an oxidizer to supply oxygen to the fuel and/or a binding agent to form the fuel and optional oxidizer into particles. The compositions are useful as ignitors or squibbs, and can be used in industrial tools, seatbelt pretensioning systems, and airbags.

2 Claims, No Drawings

COMBUSTIBLE COMPOSITION FOR USE IN VEHICLE SAFETY SYSTEMS

This application is a continuation of U.S. application Ser. No. 08/858,183 filed on May 28, 1997, now abandoned, which claims U.S. provisional patent application Ser. No. 60/018,692, filed on May 30, 1996, and the entire disclosure of the prior applications is hereby incorporated herein by reference.

FIELD OF THE INVENTION

The invention provides a composition that can be used as an ignitor or as a propellant in many applications, including vehicle seatbelt pretensioning or airbag deployment.

BACKGROUND

Automotive engineers have sought to provide systems that reduce the injuries that people sustain in a collision and that are very comfortable to the occupants within the automobile when the systems are not needed. Two systems devised by these engineers are (1) seatbelts having a pretensioner which activates during a collision, and (2) airbags.

A seatbelt with pretensioner allows free movement of the seatbelt while an occupant rides in the automobile. If the automobile is involved in an accident, the pretensioner system automatically tensions the seatbelt within the first few moments of the accident by igniting a combustible mixture that expands against a mechanical tensioning system for the belt. The occupant is held in place by the tightened seatbelt, and many injuries are avoided.

Airbags are also used to prevent and minimize injuries. Airbags are usually folded and neatly integrated within the automobile's interior when not needed to provide an aesthetically pleasing environment. However, if the car is involved in an accident, sensors within the airbag deployment system sense the deceleration force and direction and deploy the appropriate airbags within the automobile to restrain the occupant's movements and again prevent or minimize injuries. Airbags are usually deployed by igniting a combustible mixture within the first few moments of the accident and allowing the products of combustion to fill the airbag.

Automotive safety engineers are incorporating more airbags into automobiles in an effort to minimize injuries during a crash. Driver and front-seat passenger airbags are common in many automobiles and are mounted in the steering wheel and in the dash facing the passenger, respectively. Some automobile manufacturers are now also incorporating airbags into the doors of automobiles to restrain an occupant's movement toward the door and window glass during a collision, and it is likely that multiple airbags will be located throughout the car to protect both front- and rear-seat passengers during collisions. Airbags are also being introduced into passenger aircraft.

Seatbelt pretensioning systems and airbag deployment systems typically utilize a combustible composition to provide the motive force that tensions the seatbelt or that deploys the airbag. The composition combines with a source of oxygen when ignited and produces a large amount of gas to provide sufficient pressure to tension the seatbelt or to provide a sufficient volume of gas to deploy the airbag.

The amount of gas generated from the combustible composition increases substantially as more airbags and seatbelt pretensioners are added to vehicles. The gas is present within the vehicle's interior after the accident occurs, and an occupant rendered unconscious by the crash can inhale the gas for a long period of time before the occupant is extracted from the wrecked vehicle.

Propellants used in airbags or seatbelt pretensioning systems to date produce large amounts of noxious or toxic gases such as NO, $NO_2$, carbon monoxide, $SO_x$, HCl, $NH_3$, or HF. Two common propellants used in these systems are nitrocellulose and $BKNO_3$. Nitrocellulose is usually an unstable composition that degrades rapidly at the conditions present within an automobile's interior. Consequently, nitrocellulose for use in airbags or seatbelt pretensioners usually has substantial amounts of stabilizer added to it to prevent premature combustion in hot conditions. Nitrocellulose also produces large amounts of NO, $NO_2$, and carbon monoxide to which a person is exposed when an airbag or seatbelt pretensioner activates. $BKNO_3$ is a fairly stable material at the conditions present within an automobile's interior, but, when $BKNO_3$ is ignited, it produces large amounts of NO and $NO_2$. Thus, the amount of toxic gases to which an occupant of an automobile involved in a crash is exposed increases substantially as the number of airbags and seatbelt pretensioners within the vehicle increases.

It is therefore an object of this invention to provide combustible compositions that are suitable as propellants for, e.g., airbags or seatbelt pretensioners, or for other purposes.

It is an object of this invention in certain preferred embodiments to provide combustible compositions that are suitable as propellants for airbags or for seatbelt pretensioners and which produce little or no NO, $NO_2$, carbon monoxide, $SO_x$, HCl, $NH_3$, and HF.

Further objects are apparent from the discussion herein.

SUMMARY OF THE INVENTION

The invention provides a combustible composition that uses, as a fuel, an organic compound having a high ratio of the number of reactive carbon-oxygen groups to the total number of carbon atoms in the fuel. The composition also contains an oxidizer to supply oxygen to the fuel and/or a binding agent to bind molecules of the fuel and optional oxidizer into larger particles. The combustible composition is used to generate a gas that can be used in such microgas-generator applications as airbag inflation or seatbelt pretensioning. The invention also provides airbag and seatbelt pretensioning systems using a composition of this invention.

The invention also provides methods of using the fuel described above in airbag and seatbelt pretensioning systems. Among other factors, the invention is based on the technical finding that a fuel such as a poly-alcohol having a high ratio of reactive carbon-oxygen groups to total carbon atoms in the fuel produces a large volume of gas that has very low levels of toxic compounds in the gas. When propellant particles are formed of a poly-alcohol such as pentaerythritol, an oxidizer such as potassium perchlorate, and a binding agent such as (vinylidene fluoride-perfluoropropylene) copolymer, the propellant exhibits a fast, controllable, and non-explosive bum time, good gas pressure and volume generation, excellent stability at ambient and elevated temperatures, well-controlled ignition properties, little or no smoke generation, and low flame temperature, and the propellant is inexpensive to manufacture. Other embodiments of the invention, technical findings, and advantages are apparent from the discussion herein.

DETAILED DESCRIPTION OF THE PREFERRED EMBODIMENT

This invention provides compositions which generate a gas that can be used within vehicle safety systems to pretension seatbelts or deploy airbags. The invention also provides new methods of using existing compounds to generate such gas.

In one embodiment of the invention, the composition which generates a gas comprises a fuel and an oxidizer. The fuel is a compound that produces a large quantity of gaseous molecules when the fuel is oxidized. The oxidizer supplies oxygen that combines with the fuel to generate gaseous molecules.

The fuel is an organic compound that has reactive carbon-oxygen groups, which groups readily combine with oxygen from the oxidizer and/or from the air when the fuel is ignited or which groups facilitate the process of combining adjacent portions of the compound with oxygen. Compounds that contain reactive carbon-oxygen groups include alcohols (including secondary and tertiary alcohols), ketones, aldehydes, ethers, peroxides, and acids. For purposes of this invention, a reactive carbon-oxygen group has an oxygen atom that is chemically bonded to hydrogen, carbon, or oxygen but not to another type of atom such as nitrogen.. Esters are not generally considered to contain reactive carbon-oxygen groups, since the ester moiety does not combine or readily promote other portions of the molecule to combine with oxygen. However, when ester moieties are present in a compound that contains other reactive carbon-oxygen groups, the ester moieties can form gaseous molecules such as $CO_2$ or methyl formate, which contribute to the total volume of gas produced. Consequently, it can be beneficial to have some ester moieties within compounds that contain reactive carbon-oxygen groups.

The fuel contains a high ratio of reactive carbon-oxygen groups to total carbon atoms present in the fuel. A fuel contains a high ratio of reactive carbon-oxygen groups when a powder formed by copreciptitating or blending this fuel with a sufficient amount of oxidizer to supply a stoichiometric excess of oxygen during combustion burns rapidly (deflagrates) without detonating when in a confined space that allows pressure to build and produces a concentration of carbon monoxide in the gaseous products of combustion that is less than 100 ppm per gram of propellant burned to a volume of 100 $ft^3$. Preferably, a fuel produces less than 50 ppm carbon monoxide per gram of propellant, and more preferably, the fuel produces less than 20 ppm carbon monoxide per gram of propellant when burned in a composition and at conditions described immediately above. In a preferred embodiment of the invention, the fuel contains at least about 60 reactive carbon-oxygen groups per 100 carbon atoms in the fuel. More preferably, the fuel contains more than about 80 reactive carbon-oxygen groups per 100 carbon atoms in the fuel. Table 1 provides some exemplary compounds and the number of reactive carbon-oxygen groups per 100 carbon atoms.

TABLE 1

| REF NO. | COMPOUND | NO. OF REACTIVE CARBON-OXYGEN GROUPS PER MOLECULE | NO. OF CARBON ATOMS PER MOLECULE | NO. OF REACTIVE CARBON-OXYGEN GROUPS PER 100 CARBON ATOMS (APPROX.) |
|---|---|---|---|---|
| 1 | pentaerythritol | 4 | 5 | 80 |
| 2 | oxamide | 2 | 2 | 100 |
| 3 | oxalic dihydrazide | 2 | 2 | 100 |
| 4 | glycine | 1 | 2 | 50 |

TABLE 1-continued

| REF NO. | COMPOUND | NO. OF REACTIVE CARBON-OXYGEN GROUPS PER MOLECULE | NO. OF CARBON ATOMS PER MOLECULE | NO. OF REACTIVE CARBON-OXYGEN GROUPS PER 100 CARBON ATOMS (APPROX.) |
|---|---|---|---|---|
| 5 | sodium gluconate | 7 | 7 | 100 |
| 6 | sorbose | 6 | 6 | 100 |
| 7 | ascorbic acid | 6 | 6 | 100 |
| 8 | potassium acetate | 1 | 2 | 50 |
| 9 | potassium citrate | 4 | 6 | 67 |
| 10 | lactose | 11 | 12 | 92 |
| 11 | glucose | 6 | 6 | 100 |
| 12 | sorbitol | 6 | 6 | 100 |
| 13 | gluconic acid | 6 | 6 | 100 |
| 14 | glucuronic acid | 6 | 6 | 100 |
| 15 | fructose | 6 | 6 | 100 |
| 16 | erythritol | 4 | 4 | 100 |
| 17 | monomethyl ether diethylene glycol | 3 | 5 | 60 |
| 18 | 2,3-dimethoxy-1-propanol | 3 | 5 | 60 |
| 19 | 1,1,1-trimethoxyethane | 3 | 5 | 60 |
| 20 | 1,2,3-pentanetriol | 3 | 5 | 60 |
| 21 | 2-(hydroxymethyl)-2-methyl-1,3-propanediol | 3 | 5 | 60 |
| 22 | adonitol, arabitol, xylitol | 5 | 5 | 100 |
| 23 | cyclohexane-hexone | 6 | 6 | 100 |
| 24 | 1,2,3,4,5-cyclohexanepentol | 5 | 6 | 83 |
| A | nitrocellulose | — | — | 42 |

The fuel may have other moieties in its structure that contribute to generating the gas that acts as a propellant. For example, the fuel may contain —$NO_2$, —$NO_3$, —$ONO_2$, and other moieties that dissociate from the fuel or that combine with oxygen when the fuel is ignited. When gas-generating moieties other than reactive carbon-oxygen groups are present in the fuel, the majority of the amount of gas that is generated by the fuel is derived from the reactive carbon-oxygen groups that are present in the fuel.

A molecule of fuel as described above preferably has a structure which is easily consumed during combustion and which forms large amounts of carbon dioxide and little carbon monoxide. Easily-consumed fuel molecules include low molecular-weight aliphatic compounds, and especially saturated linear, branched, or cyclic aliphatic compounds. Preferably, the fuel contains little sulfur, phosphorous, or elements other than carbon, hydrogen, and oxygen, as explained later. Aromatic compounds may be used as fuel. However, because some of the products of combustion include benzene and benzene-derivatives such as toluene and complex ring structures, aromatic compounds are generally not used as part of the composition when the gas generated by igniting the composition is to be breathed.

The oxidizer of the composition described above provides a ready supply of oxygen to the fuel during combustion. Consequently, the amount and type of oxidizer is selected to supply oxygen at a rate that is sufficient for a composition of this invention to generate gas at the rate desired for the particular application to which the gas will be applied. The oxidizer is an oxygen-rich compound or mixture of compounds that readily liberates oxygen atoms under combustion conditions. Suitable oxidizers include such compounds as: ammonium, potassium, lithium, or sodium perchlorate;

ammonium or potassium nitrate; and combinations of these compounds. Preferably the oxidizer is a compound that produces little toxic gas during combustion of the fuel.

A composition of this invention may also comprise a fuel as discussed above and a binding agent that binds fuel molecules into particles. Suitable binding agents include oligomeric or polymeric materials such as copolymers of vinylidene fluoride and perfluoropropylene (available under the trade-name of Viton rubber) and other fluoro- or fluorochloro-elastomers, polybutadiene (available under the trade-name of Kraton rubber) and other olefinic compounds, other rubbers, gums, waxes, or resins, and similar materials.

When a composition of this invention is ignited, the composition reacts to produce a sufficient volume and pressure of gas at an appropriate rate of gas production for the particular application. For a seatbelt pretensioner, it is important to provide sufficient tension to restrain the occupant of the automobile, yet not at such rate or with such force that the seatbelt itself causes major injuries because of how rapidly or how hard it squeezes or contacts the occupant. For an airbag, a sufficient volume and pressure of gas should be produced at a rate that inflates the airbag rapidly and sufficiently to prevent the occupant from contacting neighboring structures in the automobile, yet the gas should not expand so rapidly that the gas causes the airbag to explode. Nor should the gas expand with such force that the airbag causes significant injuries when it contacts the occupant of the automobile instead of cushioning the occupant from contact with the automobile and absorbing or changing some of the forces of deceleration to which the occupant is subjected.

Thus, the composition should burn smoothly and with sufficient rapidity to produce the desired pressure rise time in each of the applications discussed above, although the particular rate at which a composition burns in one application such as pretensioning a seatbelt may be different from the rate at which a composition of this invention burns in another application such as airbag deployment. It is desirable to limit the number of moieties in the fuel or in the oxidizer or otherwise in the composition that cause extremely rapid combustion of the composition. Consequently, the composition preferably has a limited number of ozonide or —$ONO_2$ or other moieties that promote extremely rapid combustion.

The particular rate at which the composition burns is affected by many factors. One major factor in determining the burn rate is the type of fuel selected. As discussed previously, the fuel should have a sufficient number of reactive carbon-oxygen groups to provide a quick but not explosive burn rate. The type of reactive carbon-oxygen group, their number, and their location within the molecular structure of the fuel are selected according to each group's well-known affinity to combine with oxygen in order to provide the desired rate at which the fuel will burn. For example, alcohol moieties combine with oxygen readily, as do ketone and aldehyde moieties. Peroxides decompose easily and, consequently, the reactive carbon-oxygen group containing an oxygen atom from the peroxide also combines with oxygen easily. Generally, a reactive carbon-oxygen group with its carbon atom located within a ring structure or within the long chain of a molecule would burn more slowly than a reactive carbon-oxygen group whose carbon atom is located at a terminus of the molecule.

The oxidizer is also selected to provide sufficient oxygen to the fuel that the composition burns at the desired rate. The oxidizer is selected for its ability to supply sufficient oxygen at the temperature at which the composition burns.

Another factor in determining the burn rate is the amount of each compound present in the composition. Where the composition comprises fuel and an oxidizer, the amount of fuel and oxidizer present in the composition can be selected to provide the desired burn rate. An oxidizer that delivers oxygen to the fuel slowly can be used to control the rate of oxidation. The oxidizer usually supplies much or essentially all of the oxygen needed for combustion, and the oxidizer preferably supplies oxygen at or above the rate needed to sustain essentially complete combustion.

The composition may comprise fuel, oxidizer, and a diluent such as a binding agent. The diluent may burn at a much slower rate than the fuel or not at all, and the diluent can be used to control the burn rate by physically separating the fuel from the oxidizer and providing longer paths for oxygen to travel before reaching the fuel by consuming some of the oxygen, or by modifying the rate of heat transfer to the reactants.

In a preferred embodiment of the invention, the composition has between about 20 and about 30 parts by weight of fuel and about 80 to about 70 parts by weight of oxidizer. The binder, if needed, is also preferably present in an amount between about 1 to about 5 parts by weight.

A composition of this invention is usually formed into particles that have different sizes. The size, density, and porosity of the particles can be selected to provide different burn rates. For example, small, dense, and highly porous particles will burn quickly, while larger particles of lower density and porosity will burn more slowly. If the composition comprises a binding agent, the use of small amounts of binding agent (typically between about 0.01 and 0.1 mole percent of the composition) enable the composition to be produced in various particle-size ranges of different burn rates.

In a particularly preferred embodiment of the invention, the composition produces low quantities of toxic gases when ignited. One of the concerns that automotive safety engineers have expressed is that an occupant breathes the gases generated by safety devices during and after a collision. A person trapped within an automobile can breathe these gases for substantial periods of time until the occupant is extracted from the wrecked automobile. Consequently, it is very desirable to minimize the amount of toxic gases generated when airbags and seatbelt pretensioners deploy.

It is therefore very desirable to supply an airbag or seatbelt pretensioning system with a propellant composition which produces little carbon monoxide, oxides of nitrogen or sulfur, or other toxic or noxious products from the reaction. Such a composition should produce quantities of gaseous products in a vehicle or other area that are generally regarded as safe and are within the limits published in *Dangerous Properties of Industrial Materials*, by N. Irving Sax. A particularly desirable fuel is a poly-alcohol as described above which has little or no nitrogen and sulfur and which has at least about 80 reactive carbon-oxygen groups per 100 carbon atoms. Two especially preferred poly-alcohols are pentaerythritol and lactose. The oxidizer also preferably has little or no nitrogen or sulfur, and it is preferably of a type and is used in an amount that supplies oxygen at a rate sufficient to minimize production of carbon monoxide and favor forming carbon dioxide. A perchorate such as potassium perchorate is a preferred oxidizer. A particularly preferred composition of this invention comprises about 20–30 weight percent pentaerythritol, about 70–80 weight percent potassium perchlorate, and about 1–5 weight percent of a Viton rubber such as Viton A or Viton B rubber.

A preferred propellant composition of this invention can also have excellent stability at elevated temperature. These compositions essentially do not decompose or ignite at temperatures exceeding 100 to 120° C. over a period of 100 hours, and particularly preferred compositions can be stable for over 1000 hours at temperatures exceeding 100 to 120° C.

A composition of this invention can be made in a number of ways. One way is to blend the compounds together. Solids or mixtures of solids and liquids can be blended in a mixer such as a tumbler, and subsequently dried and press into tablets or pellets or into a sheet that is broken-up in a coming mill and screened into fractions of various particle sizes. Another way to make a composition of this invention is to coprecipitate the compounds together, press the coprecipitated compounds into a sheet, pills, or tablets with sufficient force to provide good particle strength, and again break the sheet, pills, or tablets and screen the resulting particles into fractions of selected particle sizes. Methods of coprecipitating the components are disclosed in U.S. Pat. Nos. 3,652,350, 3,725,516, and 3,734,788, which are incorporated by reference in their entirety herein. There are, of course, other methods known to those skilled in the art to produce suitable forms for use, such as prilling, rolling, extruding, and like methods.

Additional components may be incorporated into the particles, pellets, or tablets during their manufacture as discussed above, or additional components may be blended with a composition of this invention. These additives include nitrocellulose, boron powder, lactose, potassium perchlorate, and $BKNO_3$, which can be individually added or added in various combinations to provide a composition with the desired burn rate, ease of ignition, and stability.

There are a number of advantages that various embodiments of this invention exhibit, especially for use in deploying airbags or in pretensioning seatbelts. A composition of this invention can generate a large amount of gas (in excess of 2 moles per 100 grams of composition or in excess of 4 moles per mole of fuel). The products of combustion can contain levels of toxic gases that are far below the limits of exposure listed in *Dangerous Properties of Industrial Matias*, by N. Irving Sax. The products of combustion can also be smokeless. The composition can have a low flame temperature (approximately 1212° K.), and the composition without added stabilizers can have good stability and thus not decompose or auto-ignite at temperatures exceeding 107° C. for a period of time in excess of 1200 hours. The composition can also be of low cost to manufacture. The burn rate or pressure rise time for the composition can be adjusted to suit the particular application in which the composition will be used as a propellant and can be easily varied between about 50 msec to less than or about 1 msec, by changing the burning web thickness, or varying the composition, for example.

Compositions of this invention are particularly useful for deploying airbags or pretensioning seatbelts or elsewhere where such micro-gas generators are desired. As previously noted, a seatbelt with pretensioner allows free movement of the seatbelt while an occupant rides in the automobile. If the automobile is involved in an accident, the pretensioner system automatically tensions the seatbelt within the first few moments of the accident. An accelerometer that senses the crash ignites an ignitor containing a prime and a flash, causing the propellant to burn and expand and push against a plunger. A wire is attached to one end of the plunger, and the wire is wound around a first guide of a double-guide pulley. The seatbelt fabric is attached to the pulley and is wound around the second guide. As the plunger is propelled by the gas generated from combustion of the propellant, the wire attached to the plunger unreels from the pulley and spins the pulley. This winds the seatbelt material onto the pulley, thereby removing slack in the seatbelt within approximately 5 msec of igniting the propellant and also providing some tension against the occupant of the vehicle. The occupant is held in place by the tightened seatbelt, and many injuries are avoided.

An airbag is also deployed in response to a large deceleration sensed by an accelerometer. The accelerometer sends a signal to an airbag, lighting an ignitor and thereby igniting the propellant. The propellant generates gases that expand within less than 40 msec to fill the airbag mounted in a steering-wheel, dash board, door, or the portion of a front seat that faces the rear-seat occupants. The occupants of the vehicle are thereby restrained from contacting portions of the car that cause major injuries, such as door windows and front windshield, rear-view mirror, dash-board, steering wheel and column, and other structures present within the car.

Compositions of this invention are not limited to use in airbags or seatbelt pretensioning systems, although many compositions of this invention are particularly well-suited to these uses. The compositions may also be used in place of black powder or may be used in ignitors, "squibbs," bomb ejection cartridges, or industrial power tools, for example.

The following examples are exemplary only and are not limiting on the scope of the invention described and claimed herein.

EXAMPLE 1

74 parts of potassium perchlorate are placed within a 00 mill jar, and 1200 g of stainless steel balls are added. 150–200 ml of acetone is subsequently added to the ball mill to wet the potassium perchlorate. 24 parts of pentaerythritol and 2 parts of Viton B rubber are also added to the ball mill. An additional 500–1000 ml of acetone is added to the ball mill, and the mixture is milled for 6–8 hours. The milled mixture is strained through a colander and into a stirred stainless-steel vessel, and the ball mill is washed with additional acetone, which is subsequently poured into the stirred vessel. 500–1000 ml of n-hexane is added rapidly to coprecipitate the mixture. The slurry is vacuum-filtered through a Buchner funnel, and the precipitate is permitted to dry on the filter. The dried precipitate is broken and sieved through a #16 sieve and is further dried in an oven maintained at 145–170° F. under partial vacuum (approximately 27 mm Hg) for at least 8 hours. The dried product is then re-sieved to obtain a fine powder or is pressed into pellets and crushed to the desired particle size.

EXAMPLE 2

Each compound listed in Table 1, with the exception of Compound A, is individually combined with each oxidizer selected from the group consisting of ammonium, potassium, lithium, and sodium perchlorate and ammonium and potassium nitrate, using between about 20 and 30 parts by weight of compound and about 80 to 70 parts by weight of oxidizer, respectively. Viton A or Viton B copolymer is used in an amount between about 1 to about 5 percent where needed to form a particulate composition. Compositions of this example are made by a number of methods. For some, the method of Example I is repeated, substituting the indicated components and amounts. For others, components are blended together to make the composition, which may be dried to form a powder or particles. Other methods of making these compositions may be used.

What is claimed is:

1. A combustible composition comprising a fuel, an oxidizer, and a binding agent, wherein the fuel comprises pentaerythritol and the binding agent comprises a fluoroelastomer.

2. A composition formed by the process of coprecipitating a fuel, an oxidizer, and a binding agent, wherein the fuel comprises pentaerythritol and the binding agent comprises a fluoroelastomer.

* * * * *